US005980656A

United States Patent [19]

Brenneman et al.

[11] Patent Number: 5,980,656

[45] **Date of Patent: *Nov. 9, 1999**

[54] COPPER ALLOY WITH MAGNESIUM ADDITION

[75] Inventors: William L. Brenneman, Cheshire; John F. Breedis, Trumbull, both of Conn.

[73] Assignee: Olin Corporation, New Haven, Conn.

[ * ] Notice: This patent is subject to a terminal disclaimer.

[21] Appl. No.: 08/898,694

[22] Filed: Jul. 22, 1997

[51] Int. Cl.[6] ..... C22C 9/00

[52] U.S. Cl. ..... 148/432; 420/496; 420/499

[58] Field of Search ..... 148/432; 420/496, 420/499

[56] References Cited

U.S. PATENT DOCUMENTS

| | | | |
|---|---|---|---|
| 3,677,745 | 7/1972 | Finlay et al. . | |
| 3,778,318 | 12/1973 | Finlay et al. . | |
| 4,202,688 | 5/1980 | Crane et al. . | |
| 4,305,762 | 12/1981 | Caron et al. . | |
| 4,605,532 | 8/1986 | Knorr et al. . | |
| 5,334,346 | 8/1994 | Kim et al. | 420/499 |

FOREIGN PATENT DOCUMENTS 58-199835 11/1983 Japan .

OTHER PUBLICATIONS

*Metals Handbook® Ninth Edition*, vol. 14, "Forming and Forging" (Dec. 1989) p. 447.

*Primary Examiner*—John Sheehan
*Attorney, Agent, or Firm*—Gregory S. Rosenblatt; Wiggin & Dana

[57] ABSTRACT

A copper alloy achieves high electrical conductivity, in excess of 70% IACS; high strength, ultimate tensile strength in excess of 75 ksi; good surface cosmetics; and good stampability, above 25% break, by controlled additions of magnesium, iron and phosphorous. There is a critical iron content to achieve both good stampability and high electrical conductivity and a critical phosphorous content to achieve high strength and relatively small metal phosphide particles. There is further, a critical relationship between the amount of iron and phosphorous. An additions of magnesium, in amounts of more than 0.03%, broadens the effective ratio of iron to phosphorous, widening the composition box of the alloys of the invention.

14 Claims, 8 Drawing Sheets

COPPER ALLOY WITH MAGNESIUM ADDITION

CROSS REFERENCE TO RELATED APPLICATION

This patent application is related to commonly owned U.S. patent application Ser. No. 8/898,053 entitled "Copper Alloy Having Improved Stress Relaxation" by William L. Brenneman filed on even date now U.S. Pat. No. 5,868,877. The disclosure of that patent application is incorporated by reference herein.

BACKGROUND OF THE INVENTION

1. Field of the Invention

This invention relates to a copper alloy having high strength, high electrical conductivity and good stampability. More particularly, the copper alloy contains controlled additions of magnesium, iron and phosphorous.

2. Description of Related Art

Elemental copper has a very high electrical conductivity and a relatively low strength. To be useful in commercial applications such as to be formed into leadframes or electrical connectors, copper is alloyed with various other elements, and combinations of elements, to increase strength. The alloying additions frequently impact other alloy properties. If the alloying additions are in solid solution with the copper, conductivity is frequently reduced. If the alloying additions result in large, hard, second phase particles, the surface finish of the copper alloy after cold rolling to sheet form may be marred by voids around these second phase particles. These voids can adversely affect the quality of an electrolytically deposited coating on the alloy. It is therefore, an objective to maximize the strength of a copper alloy without significantly degrading other desirable properties, such as uniform etching (in leadframe manufacture) and limited tool wear during stamping (in connecter manufacture).

Common alloying additions to copper include iron and phosphorous. An alloy designated by the Copper Development Association (CDA, Greenwich, Ct.) As copper alloy C19400 has the composition, by weight, of 2.1%–2.6% iron, 0.05%–0.20% zinc, 0.015%–0.15% phosphorous and the balance copper. Alloy C19400 has excellent stampability and an electrical conductivity of about 60% IACS (IACS stands for International Annealed Copper Standard and defines the conductivity of "pure" copper at 20° C. As 100%). Another alloy, designated by the CDA as alloy C19210, has the composition, by weight, of 0.05%–0.15% iron, 0.025%–0.04% phosphorous and the balance copper. Alloy C19210 has an electrical conductivity of about 80% IACS, but relatively poor stampability.

Magnesium is sometimes added to copper-iron-phosphorous alloys. The magnesium combines with phosphorous to form a magnesium phosphide that precipitates from the copper matrix as a discrete second phase particulate. A dispersion of magnesium phosphide particulate throughout the copper alloy increases the strength of the copper alloy and, by effectively removing phosphorous from solid solution with the copper, increases electrical conductivity.

United States Patents that disclose a copper alloy containing iron, phosphorous and magnesium include U.S. Pat. No. 4,305,762 to Caron et al. and U.S. Pat. No. 4,605,532 to Knorr et al., both of which are incorporated by reference in their entireties herein.

The Caron et al. patent discloses a copper alloy containing 0.04%–0.20% of magnesium, phosphorous and iron. The Knorr et al. patent discloses a copper alloy containing 0.01%–0.20% magnesium, 0.1%–0.4% phosphorous, 0.3%–1.6% iron and the balance copper. Published Japanese Patent Application No. JP 58-199835 by Sumitomo Electric discloses a copper alloy that contains 0.03%–0.3% of magnesium, 0.03%–0.3% iron, 0.1%–0.3% phosphorous and the balance copper.

While copper alloys containing magnesium, phosphorous and iron are known, there remains a need for a copper alloy with an improved combination of electrical conductivity, strength and stampability.

SUMMARY OF THE INVENTION

Accordingly, it is an object of the invention to provide a copper alloy that contains controlled additions of magnesium, phosphorous and iron and has a combination of high electrical conductivity, high strength, good surface cosmetics and good stampability.

It is a feature of the invention that the copper alloy contains defined amounts of the alloying additions and that both the amounts of the alloying additions and the ratios of the additions are critical.

It is a feature of the invention that the subject copper alloys have an electrical conductivity in excess of 70% IACS, an ultimate tensile strength in excess of 75 ksi, second phase particulate with a size of less than 4 microns in diameter and good stampability. The alloys of the invention are further characterized by an after rolling surface finish with minimal surface defects with the result that an electrodeposited coating applied to the copper alloy is not likely to blister during subsequent heating cycles.

In accordance with the invention, there is provided a copper alloy that consists, by weight, essentially of from 0.025% to 0.1% magnesium, from 0.07% to 0.16% phosphorous, from 0.05% to 0.43% iron with the balance being copper and unavoidable impurities. The phosphorous and the iron contents of the alloy further fall within a composition box defined by the weight percent coordinates (0.05% Fe, 0.07% P), (0.21% Fe, 0.07% P), (0.21% Fe, 0.16% P) and (0.43% Fe, 0.13% P).

The above stated objects, features and advantages will become more apparent from the specification and drawings that follow.

IN THE DRAWINGS

FIG. 1 schematically illustrates an apparatus for stamping a copper alloy.

FIG. 2 illustrates in cross-sectional representation an evaluation of stampability.

FIGS. 3 and 4 graphically illustrate the criticality of magnesium content.

Figure 8:
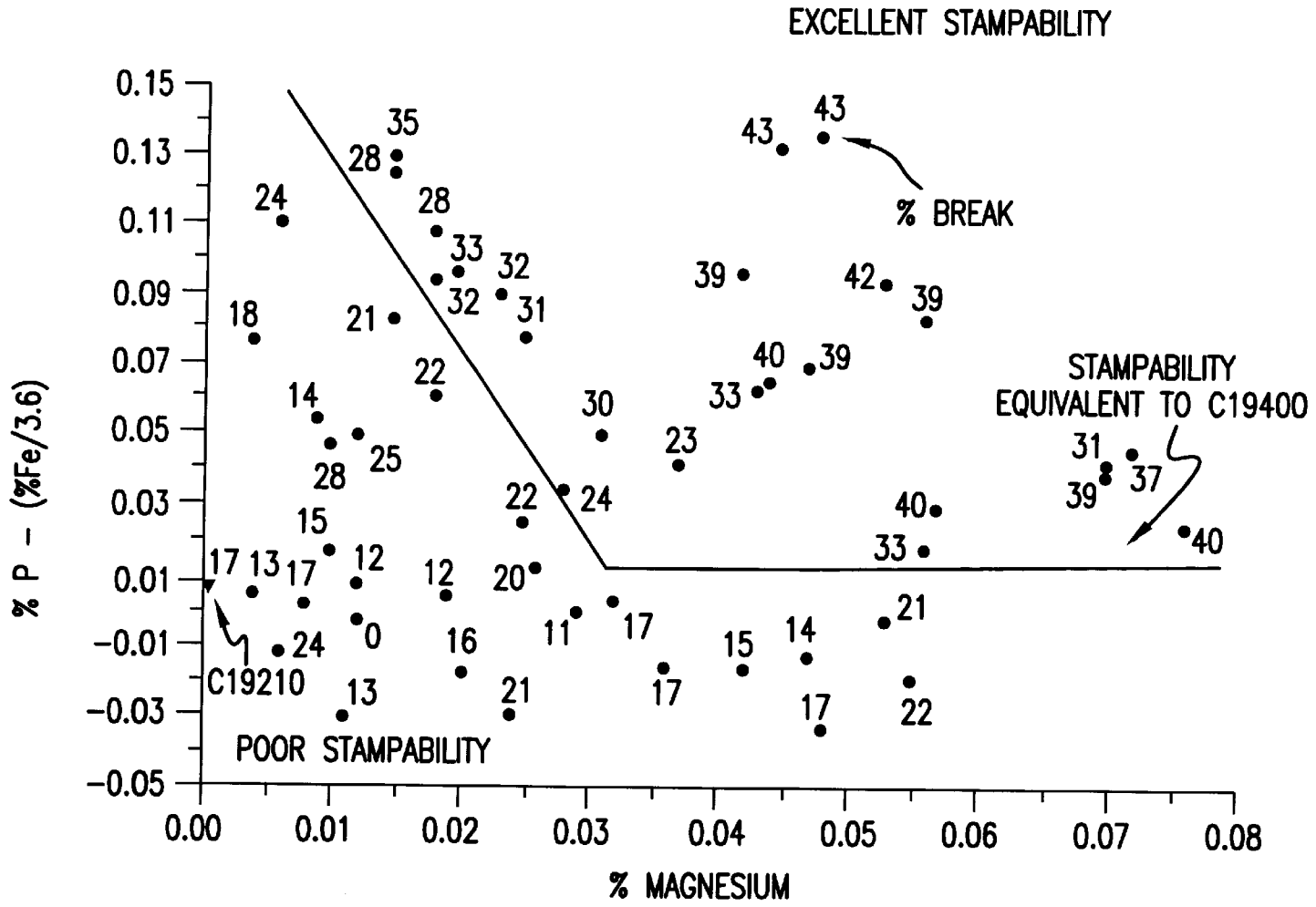

FIG. 8 graphically illustrates the criticality of the magnesium content for good stampability.

Figure 5:
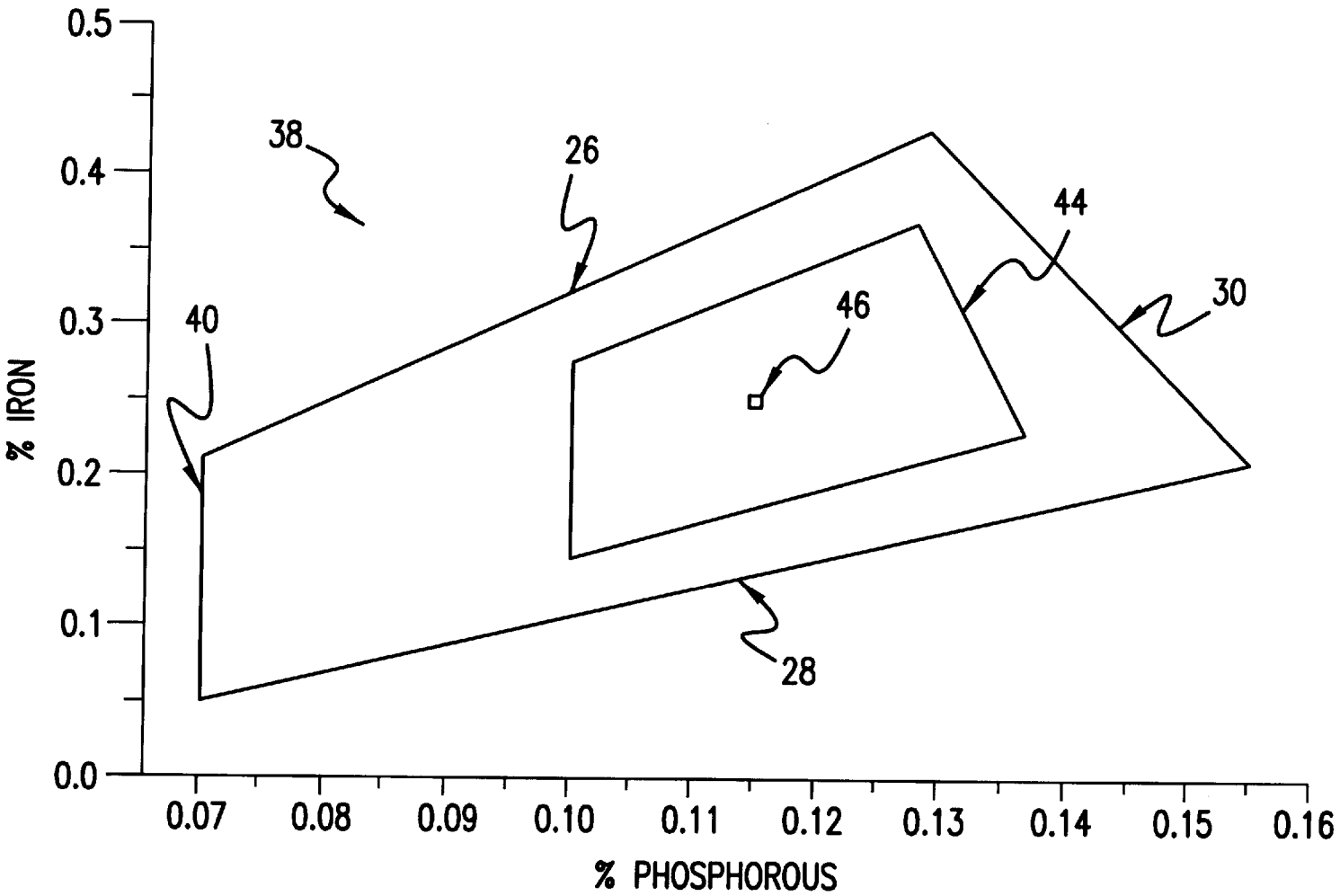
FIG. 5 illustrates the critical relationship between the percent phosphorous and the percent iron in a first alloy of the invention.
Figure 9:
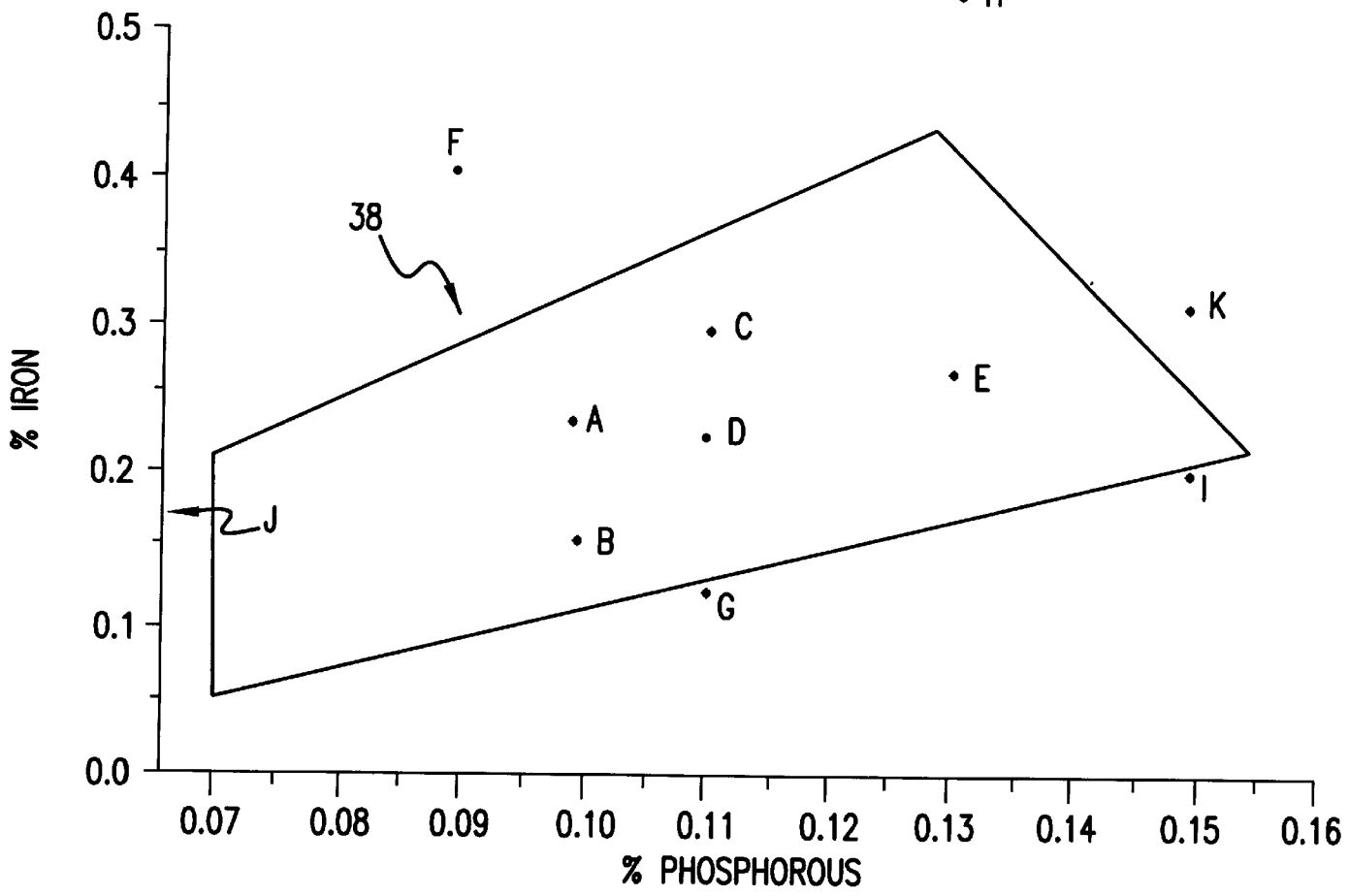

FIG. 9 graphically illustrates exemplary alloys superimposed over the composition box of FIG. 5.

DETAILED DESCRIPTION

The copper alloys of the invention are intended to be cast into ingots and then reduced in thickness to a sheet of desired thickness by a combination of hot roll reductions and cold roll reductions, possibly with intermediate anneals, as is known in the metallurgical arts. Copper alloy sheet of a desired temper is then intended to be stamped into electrical components such as leadframes and electrical connectors (plugs, jacks and sockets).

When the copper alloy sheet is to be stamped into an intricate structure, such as a leadframe, one consideration is the stampability of the copper alloy sheet. Stampability may be rated by the percentage of break (fracture) versus shear at a stamped edge for a given punch to die clearance. Materials having good stampability exhibit relatively large values of percentage break over a broad range of tool clearances and increasing the percentage of break is associated with both reduced tool wear and reduced burr height.

Figure 1:
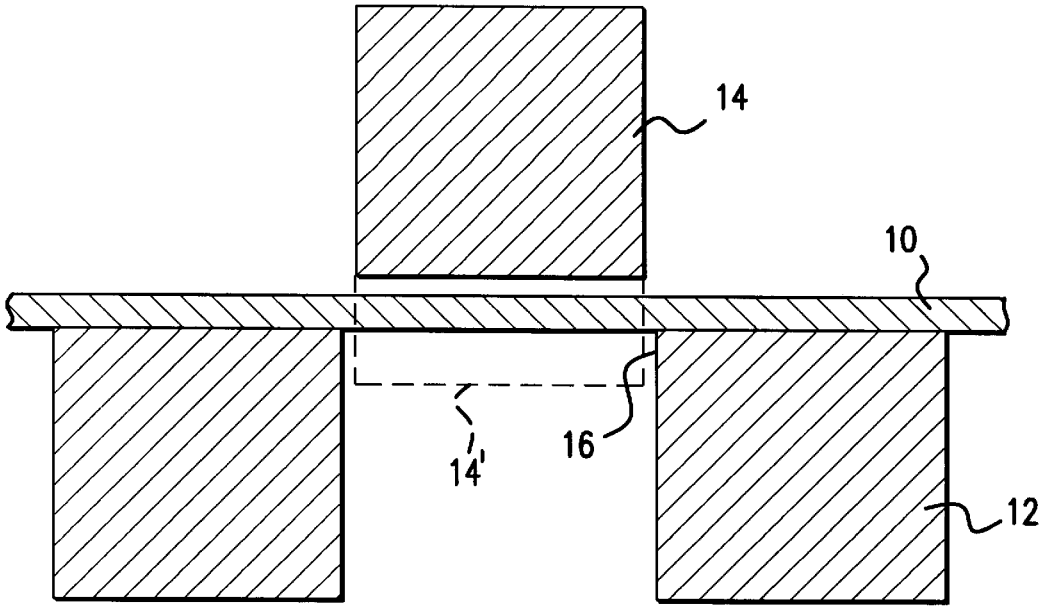

A method to evaluate stampability is schematically illustrated in FIG. 1. A copper alloy strip 10 is supported by a die 12. A punch 14 reciprocates between-the illustrated position and that indicated by the broken line 14', piercing the copper alloy strip 10. Both the die 12 and the punch 14 are formed from a material that is considerably harder than the copper alloy strip 10, such as tool steel. A clearance 16 is disposed between the punch 14 and die 12. Typically, the width of the clearance 16 is on the order of 10% of the thickness of the copper alloy strip 10.

Figure 2:
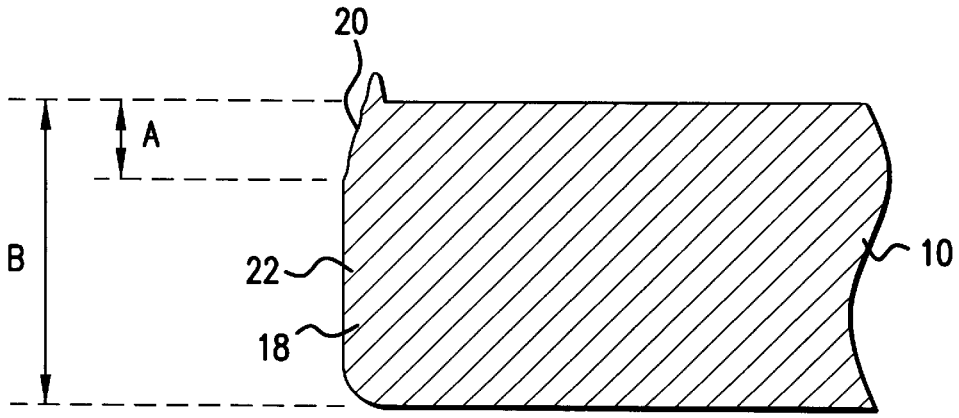

FIG. 2 illustrates in cross-sectional representation an edge 18 of the copper alloy strip 10 following stamping. A first portion 20 of the edge 18 exhibits fracture, while a second portion 22 exhibits a sheared surface indicative of tool to strip contact. A measurement of the percent of thickness of the first portion 20 (A) to the overall thickness (B) of the copper alloy strip 10, provides the percentage of break:

$$A/B\times 100\%=\%\ \text{break} \qquad 1$$

When the stamping tool has a clearance width of 10% of the strip thickness, copper alloy C19400 has about 25% break while copper alloy C19210 has only about 15% break.

Figure 3:
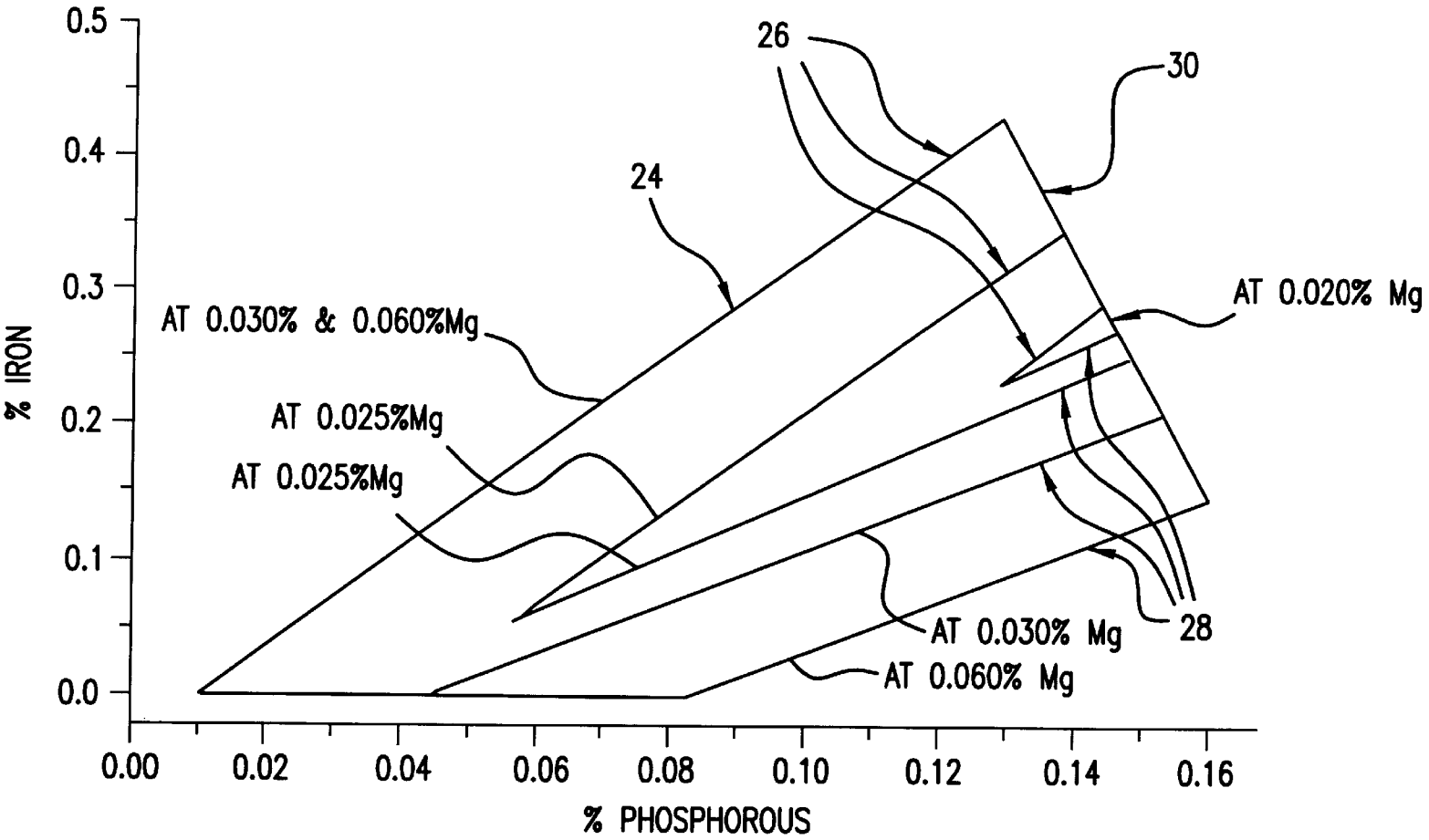

FIG. 3 graphically illustrates a critical magnesium content for the alloys of the invention. Within the composition box 24, the alloys of the invention have both good stampability, approximately equivalent to or greater than C19400, and an electrical conductivity in excess of about 70% IACS. Below the stampability limit lines 26, sufficient phosphorous is present to react with the available magnesium to form phosphides for good stampability. Above the stampability limit lines 26, insufficient phosphorous is present and poor stampability results.

Below the conductivity limit lines 28, the electrical conductivity is below 70%. Within the composition box 24, the electrical conductivity is above about 70%.

Increasing the magnesium content from 0.02% to 0.03%, by weight, significantly opens the composition box of alloy compositions with good stampability. Increasing the magnesium content beyond 0.03% does not appear to provide any further benefit to stampability. So while 0.025% of magnesium provides some benefit, a preferred critical minimum magnesium content for the alloys of the invention is 0.03%, by weight. The maximum acceptable magnesium content of about 0.1%, by weight, beyond which cracking and sliver defects develop during hot rolling of the ingot.

A preferred magnesium content of the alloys of the invention is, by weight, from 0.03% to 0.1% and a most preferred magnesium content is from 0.03% to 0.06%.

While the phosphorous content of the alloys of the invention is described in detail below, the phosphide particulate size limit line 30 identifies that content of phosphorous above which large phosphide particles form.

Figure 4:
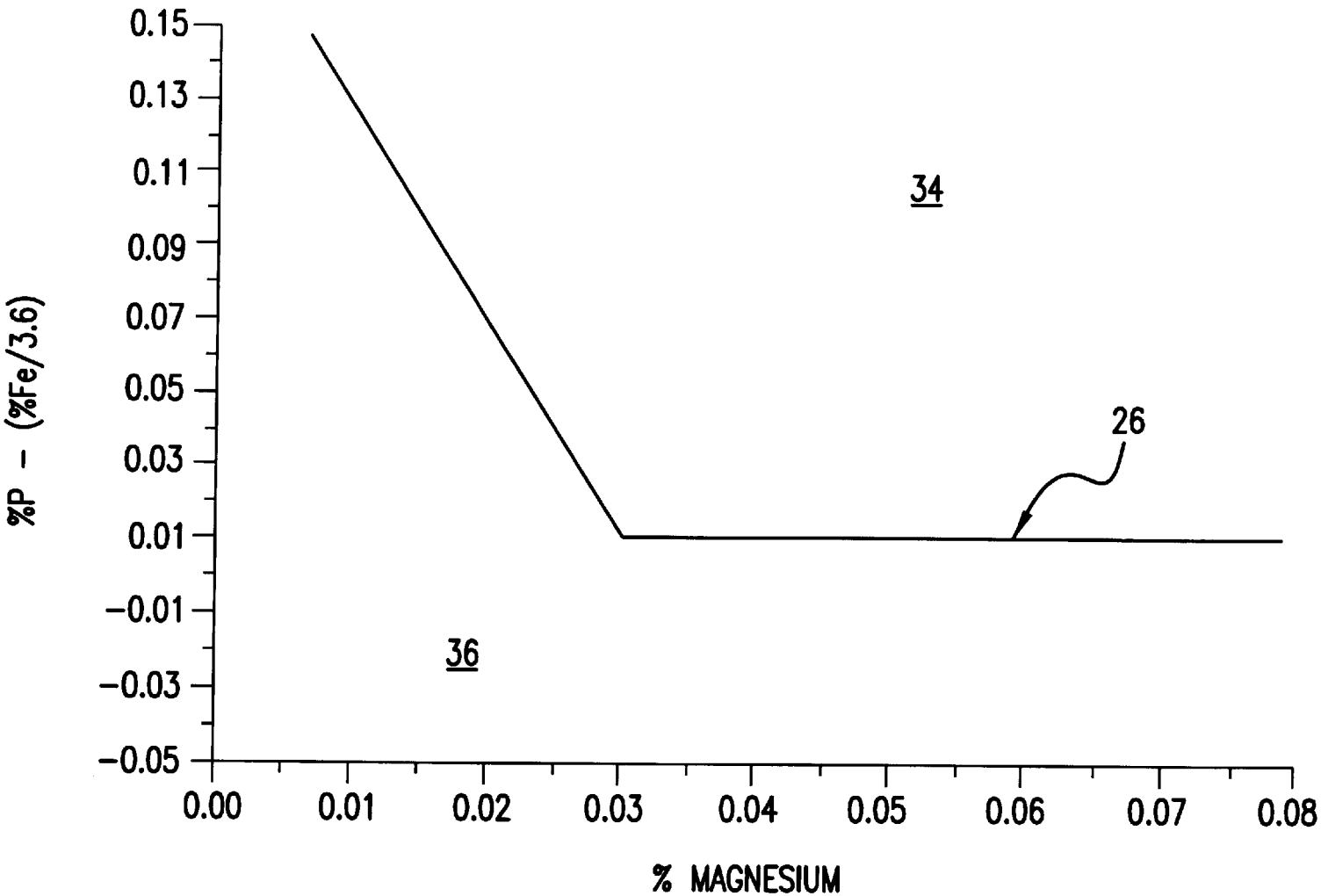

FIG. 4 graphically illustrates the criticality of the magnesium content. Along the stampability limit line 26, stampability is equivalent to copper alloy C19400. Above the line 26 is an excellent stampability region 34. Below the line 26, is a poor stampability region 36.

The vertical axis of FIG. 4 is expressed, in weight percent, as:

$$\%P-\%Fe/3.6. \qquad 2$$

Equation (2) was selected for the vertical axis because iron and phosphorous combine in approximately that ratio to form iron phosphide. It is desirable that there is sufficient phosphorous to combine with all the iron because iron remaining in solution in the copper matrix will reduce conductivity.

When $$\%P-\%Fe/3.6=0, \qquad 3$$

there is stoichiometric balance between the phosphorous and the iron. Stoichiometric balance is not desirable. It is preferred that there is an excess of phosphorous to form magnesium phosphide. The duplex nature of the second phase of the alloys of the invention, a combination of magnesium phosphide and iron phosphide, is believed to contribute to the high strength and excellent stampability.

When the magnesium content is in the most preferred range of 0.03% to 0.06%, the iron and phosphorous contents are defined by the composition box 38 graphically illustrated in FIG. 5. When the phosphorous content is less than 0.07%, the ultimate tensile strength of the alloy is less than about 75 ksi. This is because a fine dispersion of both iron phosphide and magnesium phosphide particles are required to promote both high tensile strength and good stampability. Below the ultimate tensile strength limit line 40, insufficient phosphorous is available to form the requisite phosphides. The maximum phosphorous content is defined by the phosphide particulate size limit line 30. When the phosphorous content exceeds the limit defined by line 30, large, in excess of about 4 microns in diameter, particles form. These particles in the alloy microstructure may cause irregularities in the electroplated layers when the particles appear at the surface of the alloy material. The plating irregularities, such as blisters, are typically not acceptable for electrical applications.

Exceeding the stampability limit line 26, reduces stampability by the failure to provide an adequate number of magnesium phosphide particles. Below the conductivity limit line 28, excess phosphorous remains in solid solution with the copper and electrical conductivity is below 70% IACS.

From FIG. 5, the phosphorous content of the alloys of the invention is, by weight, from 0.07% to 0.16% and the iron content from 0.05% to 0.43% with the further restriction that the phosphorous and iron contents fall within a composition box defined by the weight percent coordinates of (0.05% Fe, 0.07% P), (0.21% Fe, 0.07% P), (0.21% Fe, 0.16% P) and (0.43% Fe, 0.13% P).

More preferred iron and phosphorous contents are defined by the composition box 44, centered around a target 46 of 0.115% phosphorous and 0.25% iron and defined by the coordinates (0.14% Fe, 0.1% P), (0.27% Fe, 0.1% P), (0.23% Fe, 0.14% P) and (0.37% Fe, 0.13% P).

While the alloys of the invention are disclosed as containing iron, it is within the scope of the invention for up to 50% of the iron to be replaced with another transition metal, such as manganese, nickel, cobalt or mixtures thereof, on a 1:1 basis by weight.

Increasing the sulfur content of the alloys improves stampability but also leads to an increase in plating defects in the form of nodules. If the alloy is to be electrolytically coated, such as with silver, then the sulphur content of the alloy should be less than about 10 ppm, and preferably less than 7 ppm.

The size and frequency of plating nodules decreases with decreasing sulphur content. Nodules smaller than 0.05 millimeter are considered acceptable in most applications, thus requiring that the sulphur content be held to below about 10 ppm.

Tin is a preferred addition to the alloys of the invention. The addition of tin increases strength, but typically reduces electrical conductivity as well. Preferably, the tin content is, by weight, from 0.05% to 0.35% and more preferably from 0.10% to 0.20%.

Figure 6:
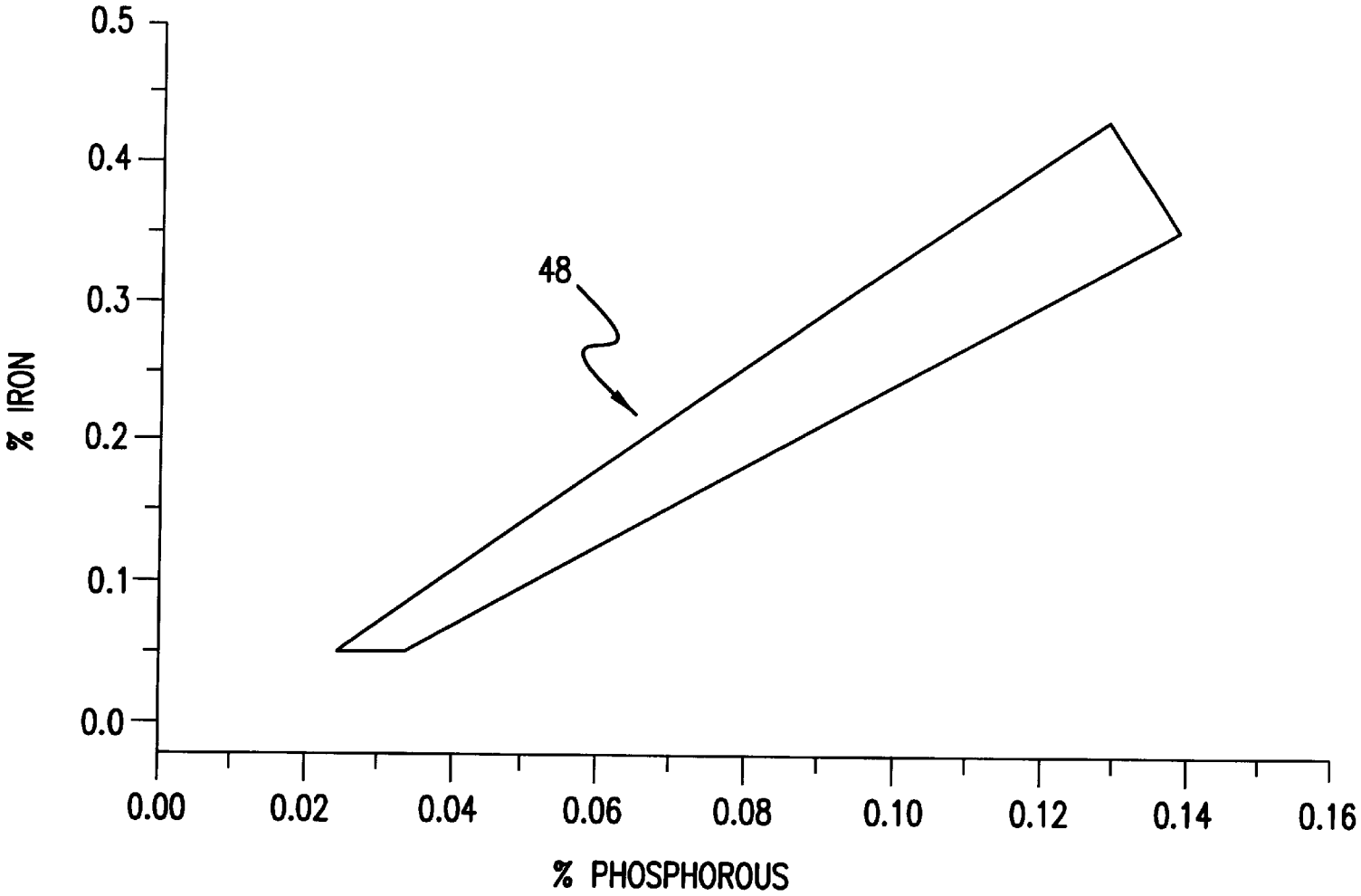
FIG. 6 illustrates the critical relationship between the percent phosphorous and the percent iron in a second, tin containing, alloy of the invention.

As illustrated in FIG. 6, the addition of 0.15% of tin narrows the composition box 48 to the coordinates of (0.05% Fe, 0.02% P), (0.05% Fe–0.033% P), (0.35% Fe, 0.14% P) and (0.43% Fe, 0.13% P).

Other additions that may be made to the alloys of the invention include aluminum, antimony and zinc. Preferably, the total cumulative content of these other additions is less than about 1%, by weight, such that the desired properties of the alloy, notably conductivity, are not detrimentally affected.

Figure 7:
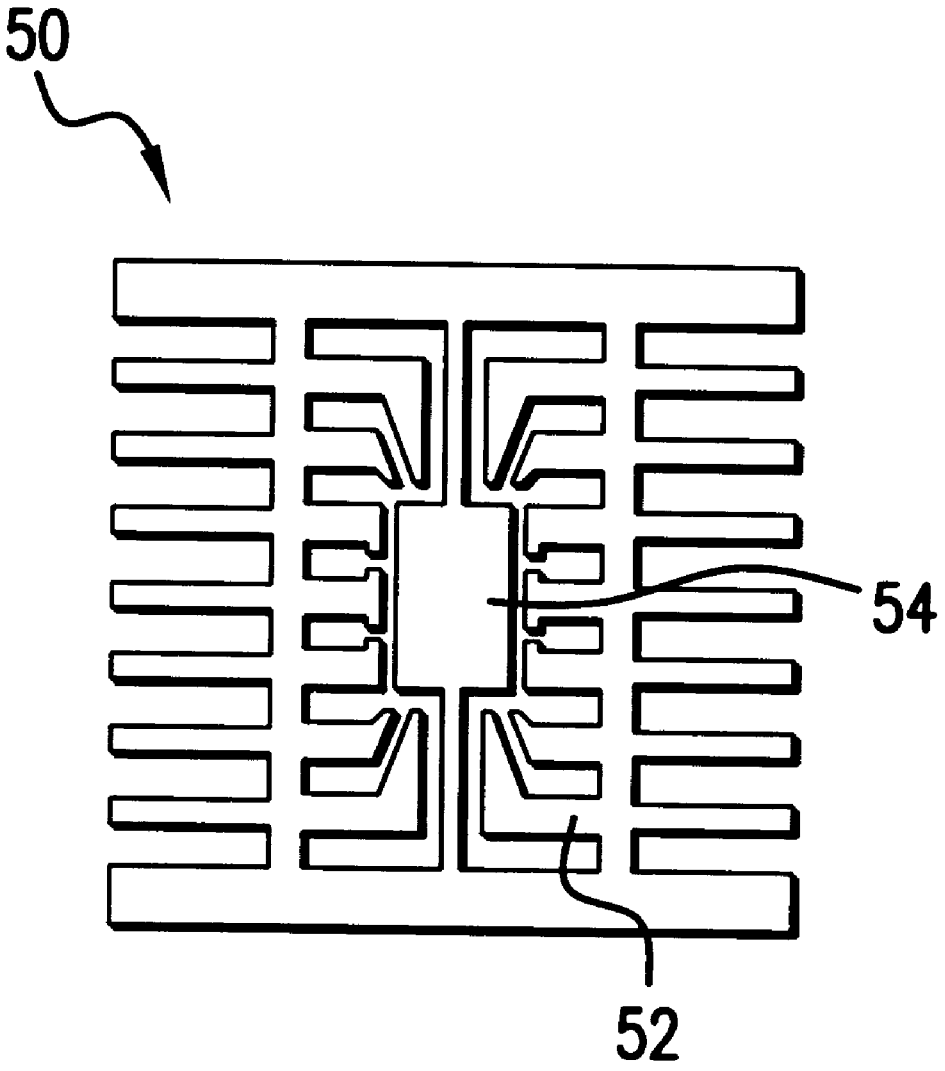
FIG. 7 illustrates a leadframe stamped from the copper alloys of the invention.

While the copper alloys of the invention are suitable for a variety of applications, particularly where high electrical conductivity and strength are required, the alloys are particularly suited for the manufacture of a stamped leadframe. As illustrated in FIG. 7, a leadframe 50 is stamped from a sheet of copper alloy, typically having a thickness of between 0.005 inch and 0.01 inch to form features such as leads 52 and die paddle 54. The lead to lead pitch is on the order of the thickness of the sheet mandating the use of a copper alloy with good stampability.

The advantages of the alloy of the invention will become more apparent from the examples that follows.

EXAMPLES

Example 1

Copper alloys containing magnesium, phosphorous and iron were cast as 10 pound ingots and provided with an extra spring/relief anneal temper by casting a bar having the approximate dimensions of 1.75 inches×4 inches×5 inches, homogenizing by heating to 930° C. for 1.5 hours and then hot rolling to a thickness of 0.5 inch. The 0.5 inch strip was then annealed at a temperature of between 300° C. and 650° C. and surface milled to remove oxides. The annealed strip was then cold rolled to a finished gage of 0.006 inch and relief annealed at 300° C. The copper alloy strips were then stamped using a die having a clearance width of 10% of the strip thickness and the percentage of break measured.

FIG. 8 illustrates the percentage of break by the numerical value next to each point and shows that when the magnesium content exceeds 0.03% and an excess of phosphorous is present, excellent stampability is achieved. When the magnesium content is less than 0.03%, progressively more phosphorous is required to achieve good stampability. Increasing the phosphorous content leads to the risk of both large phosphide particles and phosphorous remaining in solution and deteriorating electrical conductivity.

Example 2

A number of copper alloys were cast and processed as described for Example 1. Properties of the alloys were then evaluated at room temperature (20° C.) and recorded in Table 1.

TABLE 1

| Alloy | Composition (Fe/P/Mg) balance copper | Ultimate Tensile Strength (ksi) | Conductivity (% IACS) | Percent Break | Phosphide Size (microns) |
|---|---|---|---|---|---|
| A | .22/.10/.070 | 78 | 91 | 31 | less than 4 |
| B | .14/.10/.043 | 79 | 77 | 33 | less than 4 |
| C | .28/.11/.057 | 78 | 91 | 40 | less than 4 |
| D | .22/.11/.031 | 81 | 78 | 30 | less than 4 |
| E | .24/.13/.044 | 80 | 79 | 40 | less than 4 |
| F | .41/.09/.055 | 79 | 73 | 22 | less than 4 |
| G | .12/.11/.025 | 80 | 65 | 31 | less than 4 |
| H | .52/.13/.047 | 80 | 78 | 14 | greater than 4 |
| I | .20/.15/.020 | 81 | 59 | 33 | less than 4 |
| J | .17/.05/.019 | 74 | 94 | 12 | less than 4 |
| K | .29/.15/.047 | 82 | 81 | 39 | greater than 4 |

FIG. 9 graphically illustrates the alloys of Table 1 superimposed on composition box 38 of FIG. 5. Alloys A–E, the alloys of the invention, are within the composition box 38 and have an ultimate tensile strength, percent conductivity, percent break and phosphide size within the preferred ranges specified above. Alloys F–K are outside the composition box 38 and have one or more properties that do not meet the preferred ranges. Those values outside the preferred ranges are underlined in Table 1.

It is apparent that there has been provided in accordance with the invention a copper alloy that fully satisfies the objects, means and advantages set forth hereinabove. While the invention has been described in combination with embodiments, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A sulfur containing copper alloy having enhanced stampability and platability, consisting essentially of:

from 0.025 to 0.1 weight percent magnesium;

from 0.07 to 0.16 weight percent phosphorous;

from 0.05 to 0.43 weight percent iron;

sulfur in an amount of less than 10 ppm, wherein the presence of said sulfur enhances stampability while maintaining less than 10 ppm sulfur enhances platability; and the balance copper and unavoidable impurities wherein the phosphorous and iron contents fall within a composition box defined by the coordinates (0.05%Fe, 0.07%P), (0.21%Fe, 0.07%P), (0.21%Fe, 0.16%P) and (0.43%Fe, 0.13%P).

2. The copper alloy of claim 1 wherein said magnesium content is from 0.03 weight percent to 0.06 weight percent.

3. The copper alloy of claim 2 wherein up to 50%, by weight, of said iron is replaced with another transition metal, said replacement of iron with said another transition metal being on a 1:1 replacement basis, by weight.

4. The copper alloy of claim 3 wherein said another transition metal is selected from the group consisting of manganese, nickel, cobalt and alloys thereof.

5. A sulfur containing copper alloy having enhanced stampability and platability, consisting essentially of:

from 0.025 to 0.1 weight percent magnesium;

from 0.02 to 0.14 weight percent phosphorous;

from 0.05 to 0.43 weight percent iron;

from 0.05% to 0.35%, by weight, of tin;

sulfur in an amount of less than 10 ppm, wherein the presence of sulfur enhances stampability and maintaining the sulfur content at less than 10 ppm enhances platability; and the balance copper and unavoidable impurities wherein the phosphorous and iron contents fall within a composition box defined by the weight percent coordinates (0.05%Fe, 0.02%P), (0.05%Fe, 0.033%P), (0.35%Fe, 0.14%P) and (0.43%Fe, 0.13%P).

6. The copper alloy of claim 5 wherein said magnesium content is from 0.03 weight percent to 0.06 weight percent.

7. The copper alloy of claim 6 wherein said tin content is between 0.1% and 0.2%, by weight.

8. A leadframe formed from the copper alloy of claim 1.

9. A leadframe formed from the copper alloy of claim 5.

10. A copper alloy consisting essentially of:

from 0.03 to 0.06 weight percent magnesium;

from 0.07 to 0.16 weight percent phosphorous;

from 0.05 to 0.43 weight percent iron;

from 0.05% to 0.35% tin; and the balance copper and unavoidable impurities wherein the phosphorous and iron contents fall within a composition box defined by the weight percent coordinates (0.05%Fe, 0.07%P), (0.21%Fe, 0.07%P), (0.21%Fe, 0.16%P) and (0.43%Fe, 0.13%P).

11. The copper alloy of claim 10 wherein up to 50% by weight of said iron is replaced with another transition metal, said replacement of iron with said another transition metal being on a 1:1 basis, by weight.

12. The copper alloy of claim 11 wherein said another transition metal is selected from the group consisting of mangenese, nickel, cobalt and alloys thereof.

13. The copper alloy of claim 10 wherein said alloy has a maximum sulfur content of 10 ppm.

14. A leadframe formed from the copper alloy of claim 10.

* * * * *